US008281961B2

(12) United States Patent
Martin

(10) Patent No.: US 8,281,961 B2
(45) Date of Patent: Oct. 9, 2012

(54) DEVICE AND METHOD FOR ACCESSING FLUID IN CONTAINER

(75) Inventor: Carl Martin, Millersburg, PA (US)

(73) Assignee: Advanced Scientifics, Inc., Millersburg, PA (US)

( * ) Notice: Subject to any disclaimer, the term of this patent is extended or adjusted under 35 U.S.C. 154(b) by 949 days.

(21) Appl. No.: 11/753,717

(22) Filed: May 25, 2007

(65) Prior Publication Data

US 2007/0278439 A1 Dec. 6, 2007

Related U.S. Application Data

(60) Provisional application No. 60/803,410, filed on May 30, 2006.

(51) Int. Cl.
*B67D 3/00* (2006.01)

(52) U.S. Cl. ..... 222/482; 222/74; 222/476; 137/625.11; 220/254.2; 220/254.8

(58) Field of Classification Search ..... 220/254.8, 220/259.3, 259.4, 254.2; 222/74, 476, 481, 222/482, 526, 531, 537, 548, 566, 567, 570; 137/625.11
See application file for complete search history.

(56) References Cited

U.S. PATENT DOCUMENTS 1,262,757 A 4/1918 Deter
2,241,044 A * 5/1941 Stenberg ..... 222/142.9
2,961,228 A * 11/1960 Moore ..... 432/262
3,035,731 A * 5/1962 Schifter ..... 215/399
3,618,283 A 11/1971 Moore
3,877,428 A * 4/1975 Seagle et al. ..... 604/248
4,655,095 A 4/1987 Russo
5,064,100 A * 11/1991 Mural ..... 222/143
5,123,574 A * 6/1992 Poulos ..... 222/362
5,158,180 A * 10/1992 Zucker ..... 206/409
5,299,608 A * 4/1994 Bosyj ..... 141/285
5,308,580 A 5/1994 Clark
5,423,661 A 6/1995 Gabeler
5,509,551 A * 4/1996 Terrell, II ..... 215/229
5,520,296 A * 5/1996 Freed ..... 215/206
5,656,090 A * 8/1997 Preston et al. ..... 118/684
5,702,013 A * 12/1997 Freed ..... 215/206
5,738,236 A * 4/1998 Brun, Jr. ..... 220/253
5,741,237 A * 4/1998 Walker ..... 604/317
5,823,222 A * 10/1998 Minshull et al. ..... 137/15.15
5,884,679 A * 3/1999 Hansen et al. ..... 141/386
6,032,543 A 3/2000 Arthun
6,117,342 A * 9/2000 Schnell et al. ..... 210/800
6,244,518 B1 * 6/2001 Pogue ..... 239/36
6,319,465 B1 * 11/2001 Schnell et al. ..... 422/44
6,453,725 B1 * 9/2002 Dahlgren et al. ..... 73/23.42
(Continued)

*Primary Examiner* — Mickey Yu
*Assistant Examiner* — Kareen Rush
(74) *Attorney, Agent, or Firm* — McNees Wallace & Nurick LLC

(57) ABSTRACT

A device (10) and method for aseptically or non-aseptically accessing a fluid in a container (210) using an existing container opening (211). The device (10) includes a sanitary fitting (12) for attaching the device to the container over the existing container opening, and a sample coupling (14) associated with the sanitary fitting. The sanitary fitting (12) includes a first port (32), and the sample coupling (14) includes at least two second ports (52). The sample coupling (14) is rotatable relative to the sanitary fitting (12) in one direction to cause the first port (32) to successively align with each of the second ports (52), and thereby allows access to the fluid through the aligned first and second ports (32,52).

7 Claims, 8 Drawing Sheets

U.S. PATENT DOCUMENTS

| | | | | |
|---|---|---|---|---|
| 6,669,060 | B2 * | 12/2003 | De Laforcade | 222/321.1 |
| 6,848,602 | B2 | 2/2005 | deCler | |
| 6,871,669 | B2 | 3/2005 | Meyer | |
| 6,916,007 | B2 | 7/2005 | deCler | |
| 6,988,642 | B2 * | 1/2006 | Gallo et al. | 222/506 |
| 7,063,302 | B2 * | 6/2006 | Cordill | 251/208 |
| 7,343,933 | B2 * | 3/2008 | McBeth et al. | 137/625.11 |
| 2002/0074533 | A1 | 6/2002 | DeCler | |
| 2003/0062498 | A1 | 4/2003 | DeCler | |
| 2004/0102743 | A1 * | 5/2004 | Walker | 604/319 |
| 2004/0122383 | A1 * | 6/2004 | Romano et al. | 604/319 |
| 2005/0001425 | A1 | 1/2005 | deCler | |
| 2005/0076964 | A1 | 4/2005 | Whall | |
| 2005/0084410 | A1 | 4/2005 | Meyer | |
| 2005/0247371 | A1 | 11/2005 | Chadbourne | |
| 2006/0043021 | A1 | 3/2006 | Pesakovich | |
| 2006/0086750 | A1 | 4/2006 | Geyer | |
| 2007/0278439 | A1 * | 12/2007 | Martin | 251/208 |
| 2008/0054000 | A1 * | 3/2008 | Goldman | 220/360 |

* cited by examiner

DEVICE AND METHOD FOR ACCESSING FLUID IN CONTAINER

RELATED APPLICATIONS

The present non-provisional patent application is related to and claims priority benefit of an earlier-filed provisional patent application titled "Device and Method for Fluid Sampling", Ser. No. 60/803,410, filed May 30, 2006. The identified earlier-filed application is hereby incorporated by reference into the present application.

FIELD OF THE INVENTION

The present invention relates broadly to fluid control devices and methods for introducing or withdrawing a fluid into or from a container. More specifically, the present invention concerns a device and method for aseptically or non-aseptically accessing a fluid in a container, such as a large-volume tank, using an existing container opening.

BACKGROUND OF THE INVENTION

It is often desirable to sample a fluid in a container. While containers often include valves or other simple mechanisms for accessing the fluids, these simple mechanisms do not allow for maintaining the fluids and/or the interiors of the containers in aseptic or otherwise controlled conditions.

Furthermore, while more complex mechanisms are known in the art which allow for accessing the fluids while maintaining the controlled conditions, these mechanisms require substantial machining of the containers, including, in some cases, the creation of additional openings in the containers. One such mechanism, for example, involves creating an additional opening in the container, welding a fitting over the opening, and installing a septum in the fitting so that thereafter the fluid can be accessed by using a needle to penetrate the septum. It will be appreciated that such additional machining is undesirably laborious and time-consuming, and that the additional openings undesirably provide additional points through which the controlled conditions may be compromised.

Due to these and other problems and limitations, an improved device and method is needed for accessing fluid in a container.

SUMMARY OF THE INVENTION

The present invention overcomes the above-described and other problems and limitations in the prior art by providing a device and method for aseptically or non-aseptically accessing a fluid in a container, such as a large-volume tank, using an existing container opening.

In one embodiment, the device broadly comprises a sanitary fitting for attaching the device to the container over the existing container opening, and a sample coupling associated with the sanitary fitting. The sanitary fitting includes a first port, and the sample coupling includes at least two second ports. The sample coupling is rotatable relative to the sanitary fitting in one direction to cause the first port to successively align with each of the second ports, and thereby allows access to the fluid through the aligned first and second ports.

The device may further include, for each of the second ports, a nipple associated with the second port, a sample container for receiving the fluid flowing through the aligned first and second ports, and tubing extending between the nipple and the sample container. The second port, nipple, sample container, and tubing may be pre-sterilized. The device may further include one or more clamps operable to control the flow of the fluid through the tubing. The device may further include a plurality of teeth operable to allow the sample coupling to rotate relative to the sanitary fitting in the one direction and to prevent relative rotation in an opposite direction. The device may further include a stop structure for stopping rotation of the sample coupling relative to the sanitary fitting when one of the second ports is aligned with the first port. The device may further include a stop selection mechanism for disengaging the stop structure and allowing rotation of the sample coupling relative to the sanitary fitting. The stop structure may also be operable to stop rotation of the sample coupling relative to the sanitary fitting when the first port is located at a particular point between adjacent second ports. The device may further include a final stop mechanism operable to prevent rotating the sample coupling relative to the sanitary fitting more than approximately 360 degrees in the one direction. The device may further include a gasket surrounding each of the second ports, and a recess in which the gasket is received, wherein the gasket is interlockingly received in the recess so as to substantially prevent movement of the gasket relative to the second ports. The device may further include a cover operable to retain the sample coupling on the sanitary fitting. The cover may include an opening corresponding to each of the second ports and through which the respective aforementioned nipple projects.

In one embodiment, the method of the present invention broadly comprises the step of removing the aforementioned device, having been pre-sterilized, from an airtight packaging, attaching the sanitary fitting to the container over the existing container opening such that substantially no additional machining of the container is necessary to attach the device, sterilizing an inside of the container and, in so doing, an inside of the sanitary fitting, and placing the fluid inside the container. The method includes, when it is desired to sample the fluid, the step of rotating the sample coupling relative to the sanitary fitting in the one direction until the first port aligns with one of the second ports, and capturing the fluid flowing through the aligned first and second ports.

The method may further include, when it is desired to stop sampling the fluid, the step of rotating the sample coupling relative to the sanitary fitting in the one direction until the first port is no longer aligned with the one of the second ports. The method may further include, when it is desired to take a second sample, the step of rotating the sample coupling relative to the sanitary fitting in the one direction until the first port aligns with another a next one of the second ports.

Thus, it will be appreciated that the present invention advantageously allows for conveniently accessing the fluid within the container using an existing container opening, thereby avoiding laborious and time-consuming additional machining of the container and avoiding the creation of an additional point through which the controlled conditions within the container may be compromised.

These and other features of the present invention are described below in more detail in the section titled DETAILED DESCRIPTION OF THE INVENTION, below.

BRIEF DESCRIPTION OF THE DRAWING FIGURES

The following drawings form part of the present specification and are included to further demonstrate certain aspects of the present invention. The figures are examples only, and do not limit the scope of the invention. The words "top" and "bottom" are used only to convey relative location or direction, and do not limit the scope of the invention.

DETAILED DESCRIPTION OF THE INVENTION

Figure 1:
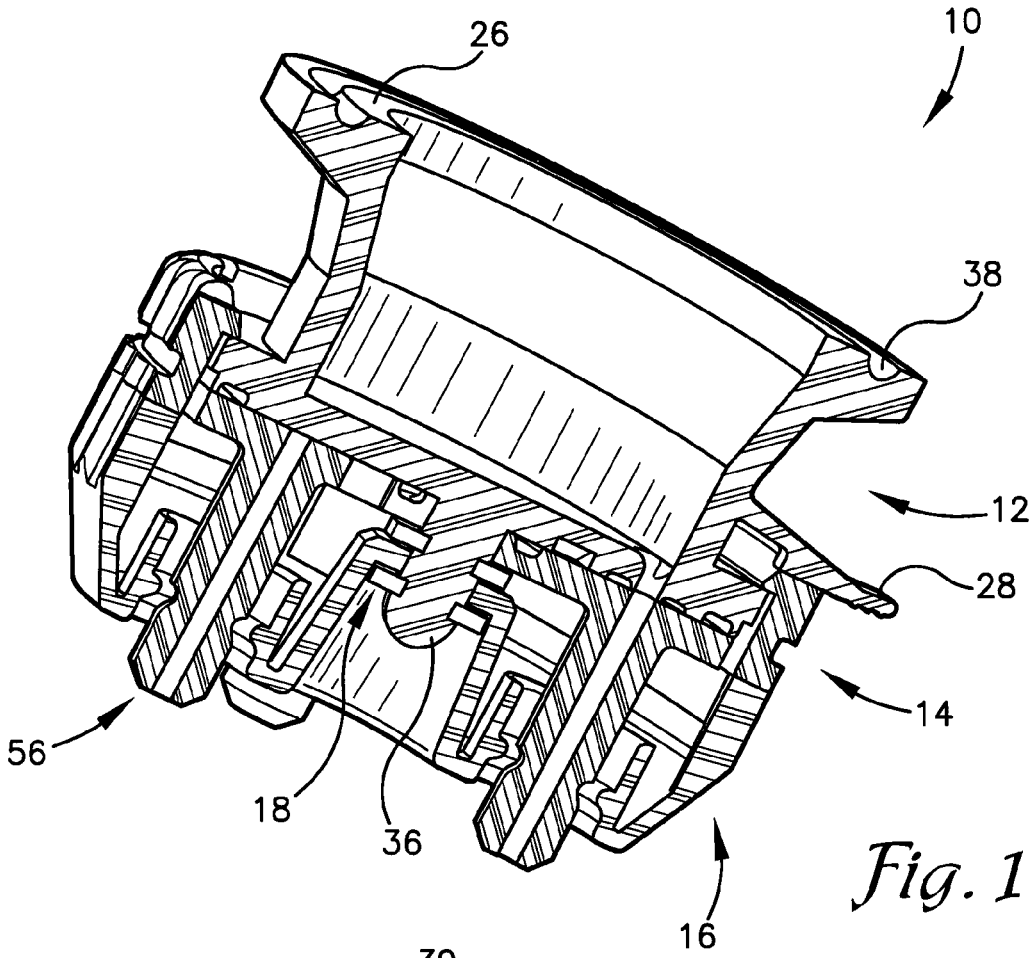
FIG. 1 is a cross-sectional perspective view of an embodiment of the device of the present invention.

With reference to the drawing figures, a device 10 and method is described, shown, and other disclosed in accordance with a preferred embodiment of the present invention. Broadly, the present invention concerns a disposable device and associated method for aseptically or non-aseptically introducing or withdrawing a fluid into or from a container using an opening which is already present in or on the container.

In one potential application, the container is a large-volume tank for producing commercial quantities of the fluid. The fluid may be a liquid, semi-liquid, gel, or paste. Whether a particular application requires aseptic or non-aseptic procedures depends on such factors as the nature of the fluid and the purpose for which the fluid will be used. For example, the present invention may be used to aseptically withdraw a sample of a biological product, such as a reagent from a tank, or to cleanly but non-aseptically withdraw a sample of an ink or drinkable spirit from a tank. As used herein, the term "aseptic" refers to both the fluid and its path through the system being maintained in a substantially sterile condition during the introduction or withdrawal process. The term "aseptic" similarly encompasses the fluid and the path being maintained in an uncontrolled or substantially controlled, but not substantially sterile, condition.

Referring to FIG. 1, a first embodiment of the device 10 broadly comprises a sanitary fitting 12; a sample coupling 14; a cover 16; and a retainer mechanism 18. For aseptic applications, the device 10 and, as discussed below, associated tubing and sample bags, may be irradiated, or otherwise sterilized, and then placed within an appropriate package so as to be substantially sterile when removed from the package for use.

Figure 2:
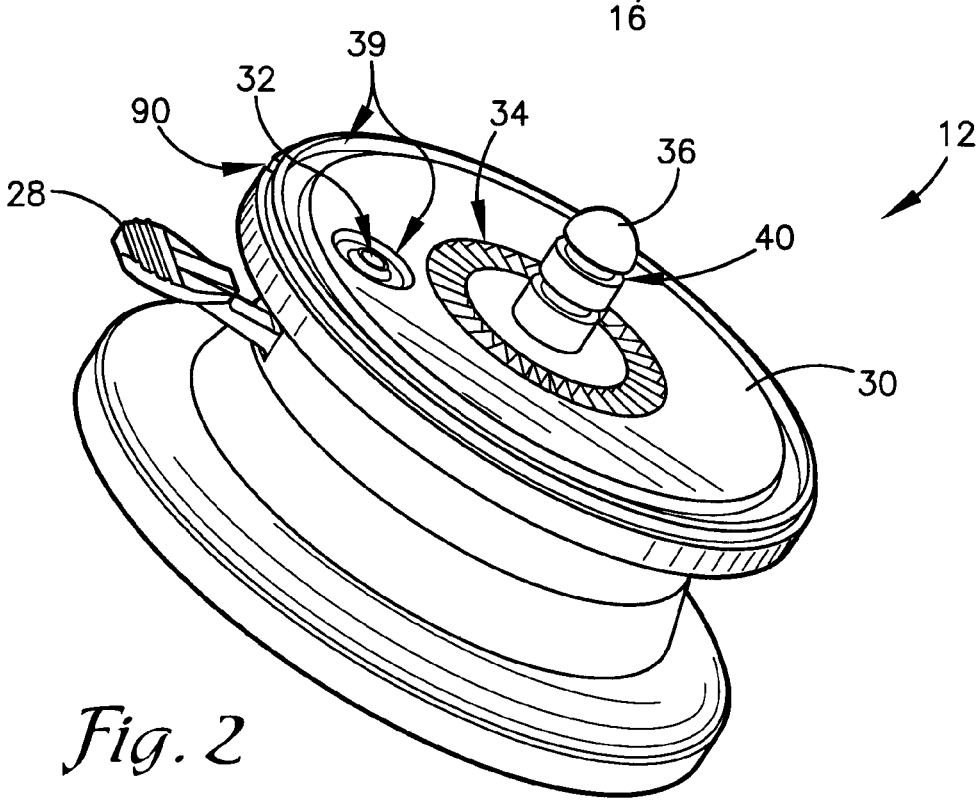
FIG. 2 is a top perspective view of a sanitary fitting component of the device of FIG. 1.

Referring also to FIG. 2, the sanitary fitting 12 allows for coupling or otherwise associating the device 10 with the existing opening in the container such that substantially no additional machining of the container is necessary in order to use the device 10. The sanitary fitting 12 includes a container mating surface 26; a stop selection mechanism 28; a sample coupling mating surface 30; a first port 32; a plurality of ratchet teeth 34; and a connector projection 36. The container mating surface 26 allows for mating the device 10 to a surface of the container surrounding the existing opening, and may include a groove 38, or channel, for receiving a gasket or O-ring for substantially sealing the container mating surface 26 to the surface of the container. The sample coupling mating surface 30 may similarly present one or more grooves 39, or channels, for receiving gaskets or O-rings for substantially sealing the sanitary fitting 12 to the sample coupling 14.

The connector projection 36 cooperates with the retainer mechanism 18 to secure the cover 16 and the sample coupling 14 to the sanitary fitting 12. To that end, the connector projection 36 may present first and second grooves 40, or channels, the function of which is described below.

Figure 3:
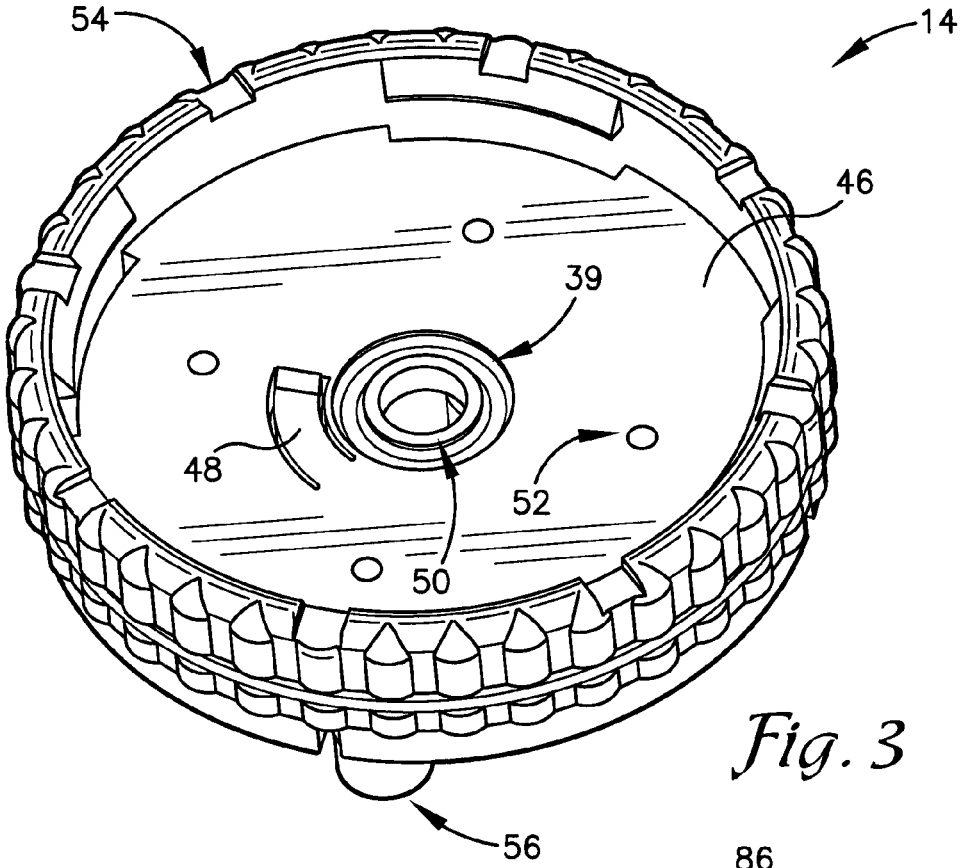
FIG. 3 is a bottom perspective view of a sample coupling component of the device of FIG. 1.
Figure 4:
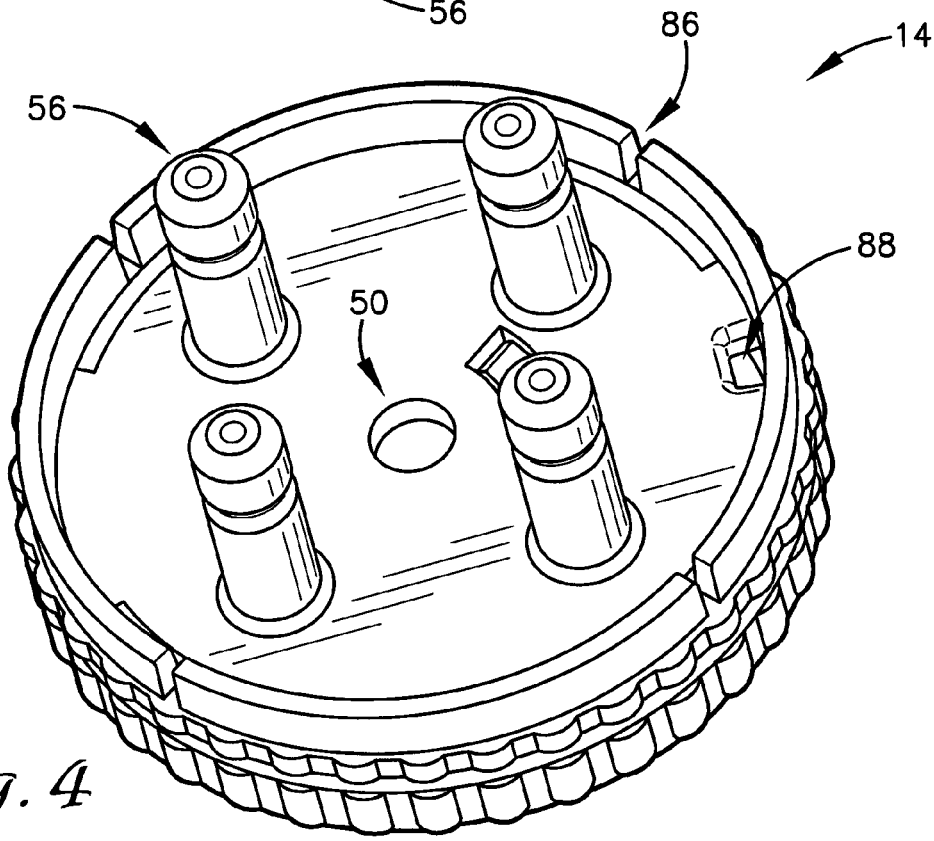
FIG. 4 is a top perspective view of the sample coupling component of FIG. 3.

Referring also to FIGS. 3 and 4, the sample coupling 14 is rotatable relative to the sanitary fitting 12 and allows for selectively sealing the sanitary fitting 12, in the upstream direction, i.e., the container side, and the sample coupling 14, tubing, and sample bags in the downstream direction, when no introduction or withdrawal of the fluid is desired, thereby preventing leaks and maintaining the internal environment of the container, and for unsealing a flowpath when introduction or withdrawal of the fluid is desired. The sample coupling 14 includes a sanitary fitting mating surface 46; a ratchet arm 48; a center orifice 50; a plurality of second ports 52; a plurality of stops 54; and a plurality of nipples 56. The sanitary fitting mating surface 46 allows for mating the sample coupling 14 with the sanitary fitting 12; specifically, with the sample coupling mating surface 30.

Figure 11:
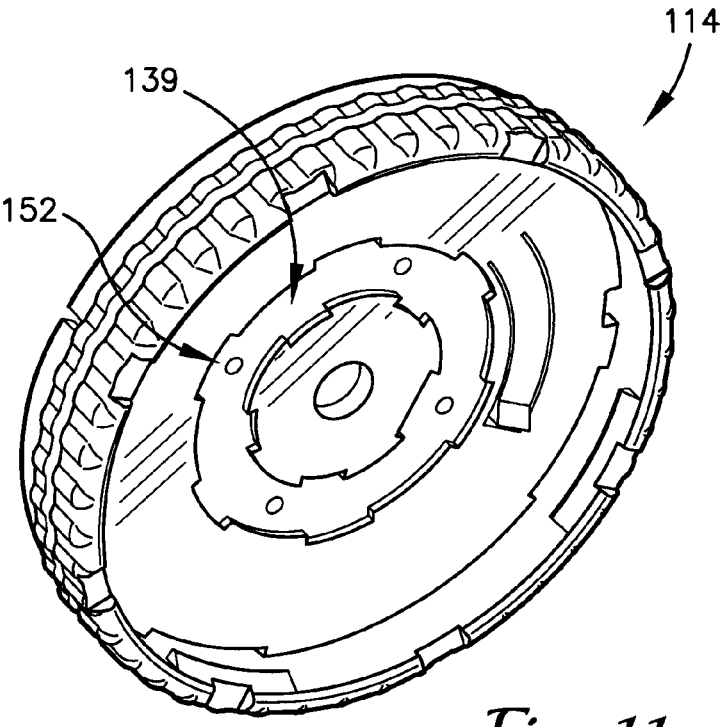
FIG. 11 is a bottom perspective view of a second embodiment of the sample coupling component.

Referring also to FIG. 11, another embodiment of the sample coupling 114 is shown having a recess 139 in the sanitary fitting mating surface 146 for receiving a gasket, wherein the recess 139 and gasket substantially surround the second ports 152, discussed below, and wherein the recess 139 interlockingly receives the gasket so as to avoid relative rotation of the gasket which could block the second ports 152. The gasket allows for sealing the two mating surfaces 30,46 together, and for eliminating certain other grooves or channels and associated gaskets or O-rings, such as those associated with the sample coupling mating surface 30, discussed above.

The ratchet arm 48 engages the plurality of ratchet teeth 34, which are inclined in the direction of rotation, in a stepped-rotation ratchet operation, allowing the sample coupling 14 to rotate in one direction relative to the sanitary fitting 12 but not in the opposite direction, thereby preventing returning to a previously used nipple 56 and associated tubing and sample bag, as described below. The plurality of second ports 52 are thereby each alignable, in turn, with the first port 32 when it is desired to introduce or withdraw fluid from the container.

The plurality of stops 54 are each spaced apart from the other and operable to receive or otherwise engage the stop selection mechanism 28 and thereby selectively stop or allow movement of the sample coupling 14 relative to the sanitary fitting 12. Each stop 54 corresponds either to an "open" position, in which the first port 32 is aligned with one of the plurality of second ports 52 such that fluid can flow out of the sanitary fitting 12 and through the sample coupling 14, or a "closed" position in which the first port 32 is not so aligned and therefore none of the fluid can flow out of the sanitary fitting 12 or through the sample coupling 14. In the illustrated embodiment, there are eight such stops 54, i.e., four "open" and four "closed".

The plurality of nipples 56 each provide a fitting for coupling the device 10 with the tubing or other structure for directing the fluid into or out of the device 10. Each of the nipples 56 is associated with a respective one of the second ports 52 and extends outwardly therefrom. The sample coupling 14 may present knurling or other contouration on its outer gripping surface to facilitate gripping the sample coupling 14 when turning it relative to the sanitary fitting 12 in order to align or not align the first port 32 with one of the second ports 52.

Figure 12:
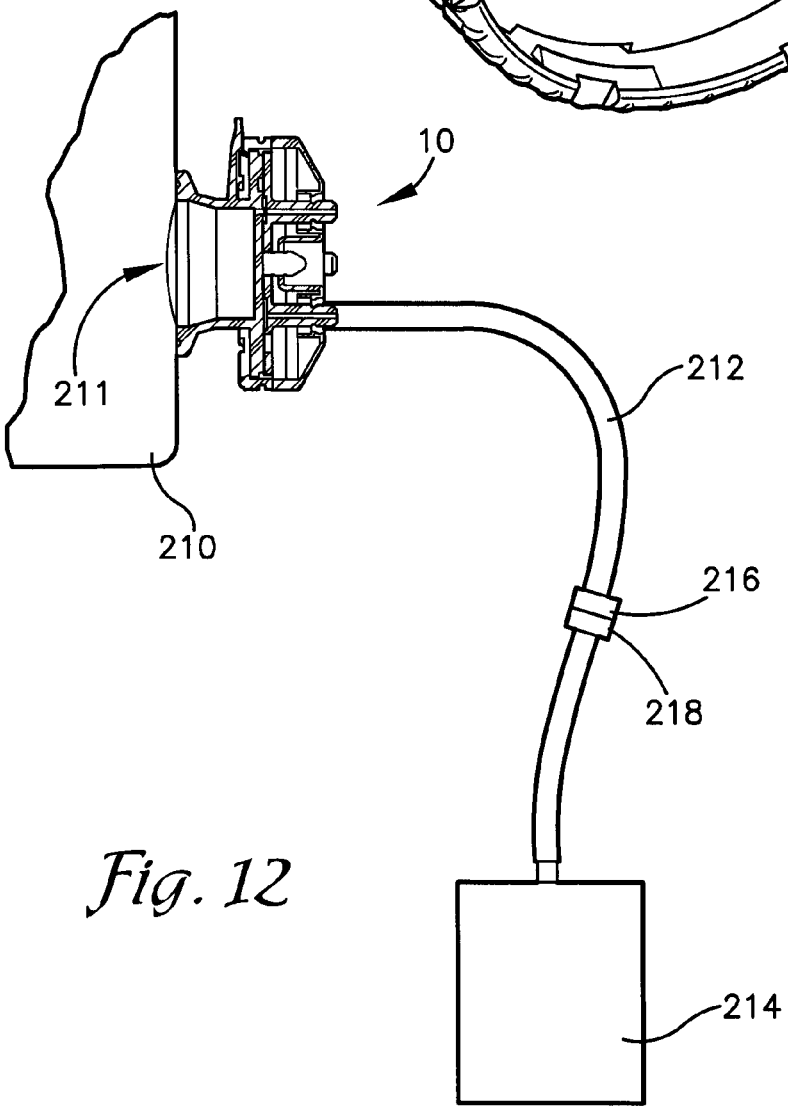
FIG. 12 is a depiction of the device of FIG. 1 attached to a container and connected by tubing to a sample bag.

In one embodiment, the tubing is provided extending from each nipple 56 to a sample bag (see FIG. 12 and the discussion thereof, below). Each length of tubing may be provided with both a pinch clamp for temporarily stopping or slowing the flow of fluid through the tubing during filling of the associated sample bag, and a cutting clamp for sealing and cutting the tubing once the associated sample bag is full.

Figure 5:
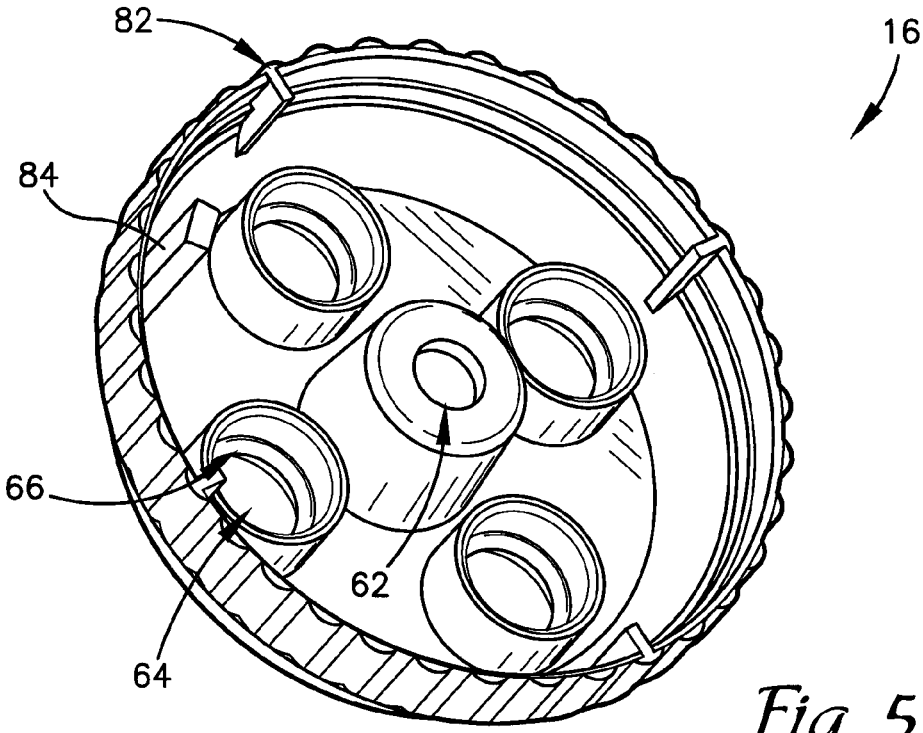
FIG. 5 is a bottom perspective view of a cover component of the device of FIG. 1.
Figure 6:
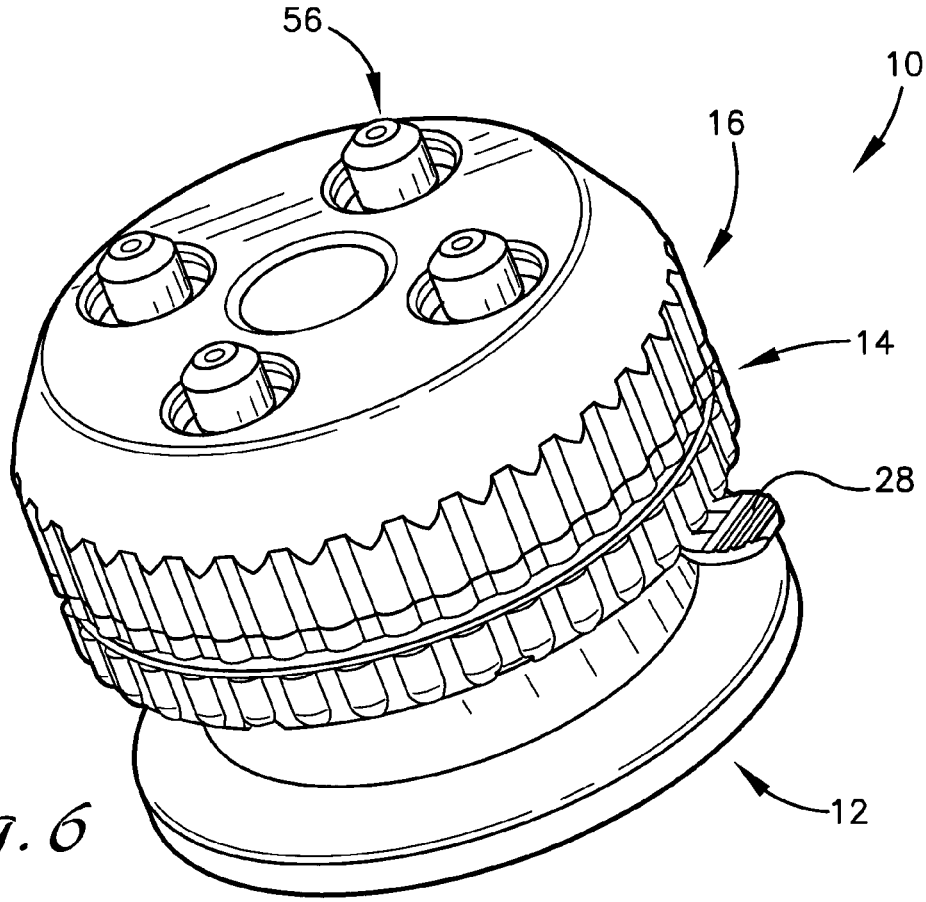
FIG. 6 is a top perspective view of the device of FIG. 1.
Figure 7:
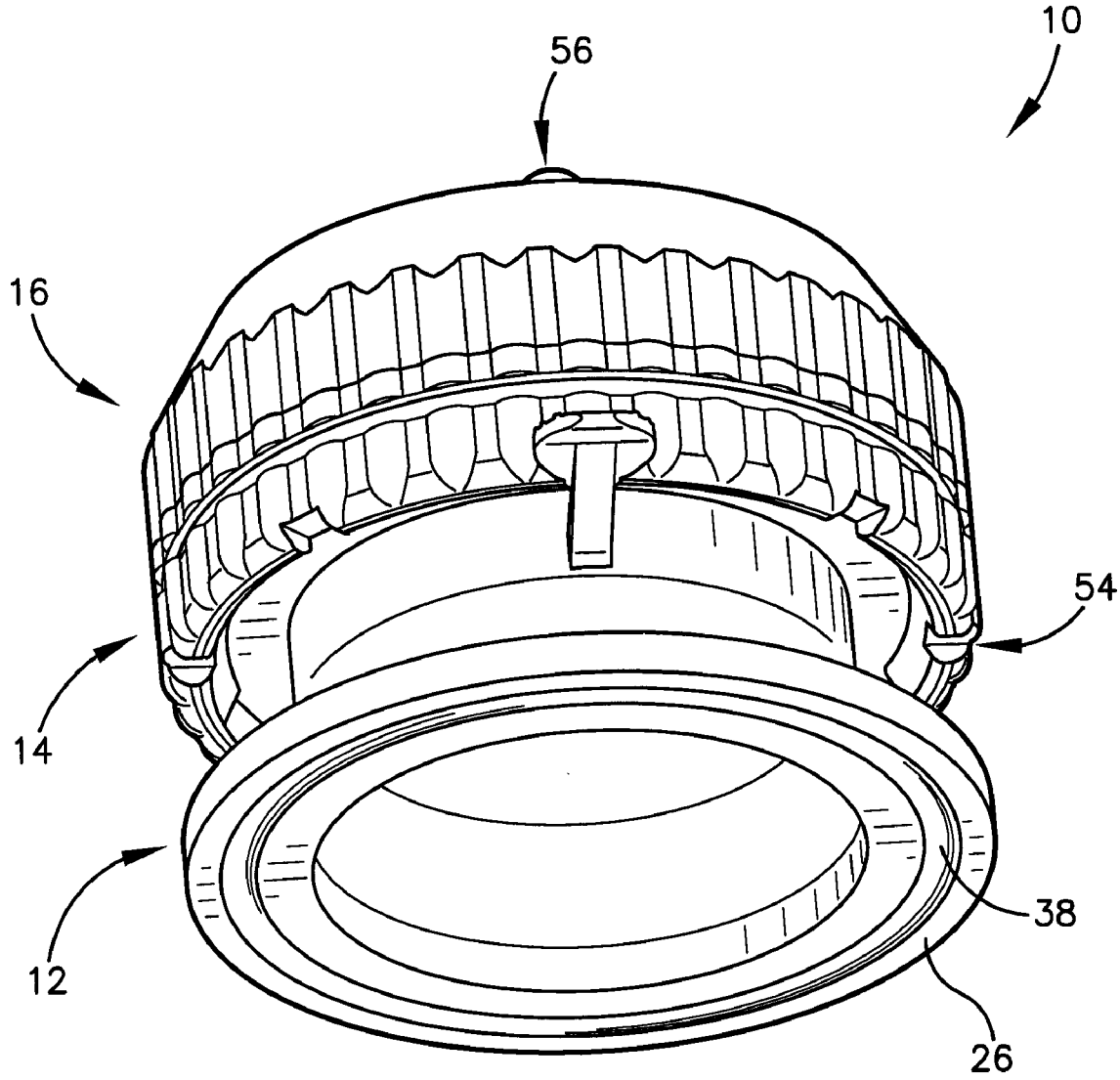
FIG. 7 is a bottom perspective view of the device of FIG. 1.
Figure 8:
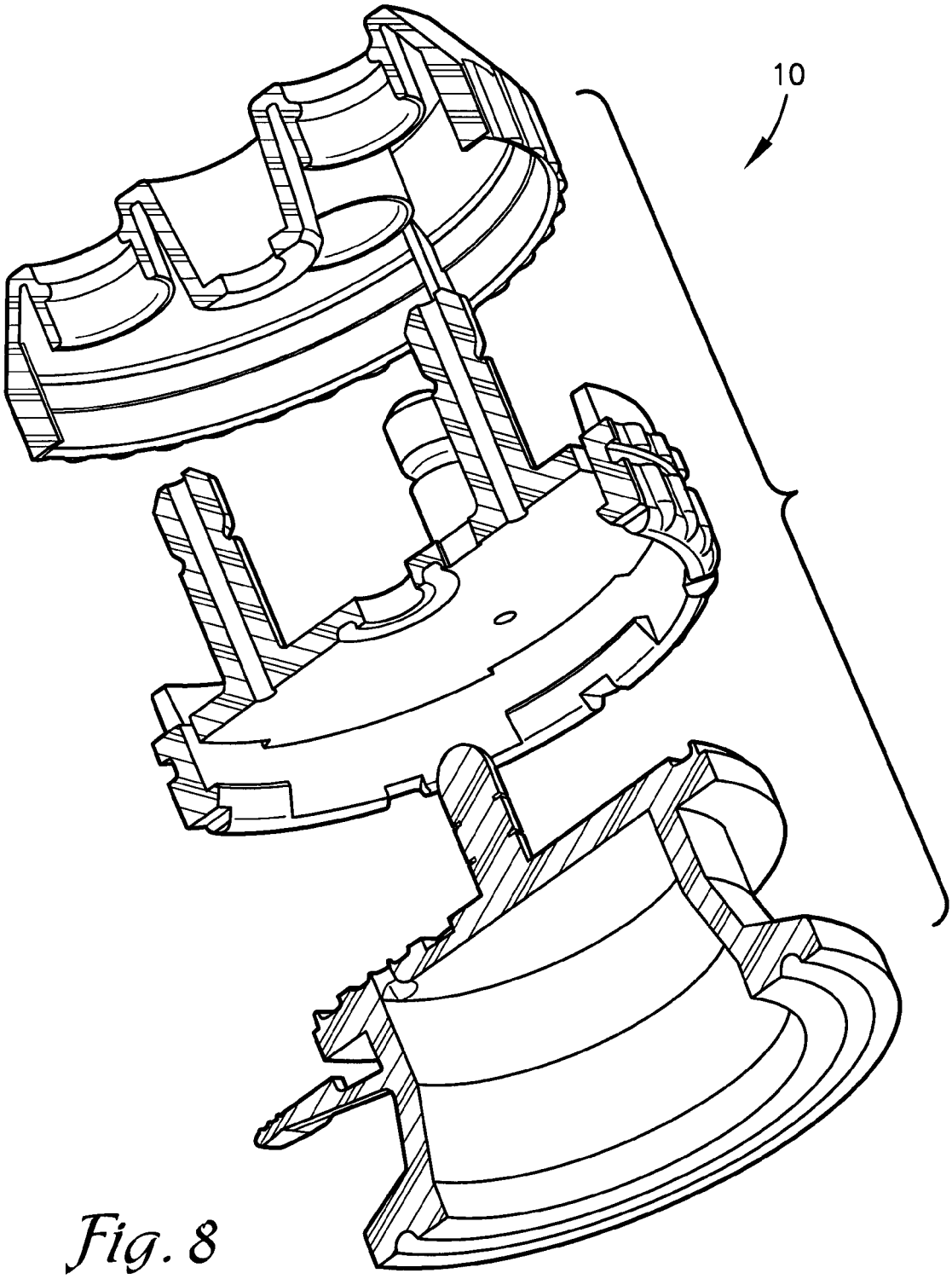
FIG. 8 is a fragmentary, exploded bottom perspective view of the device of FIG. 1, including the sanitary fitting, sample coupling, and cover components.
Figure 9:
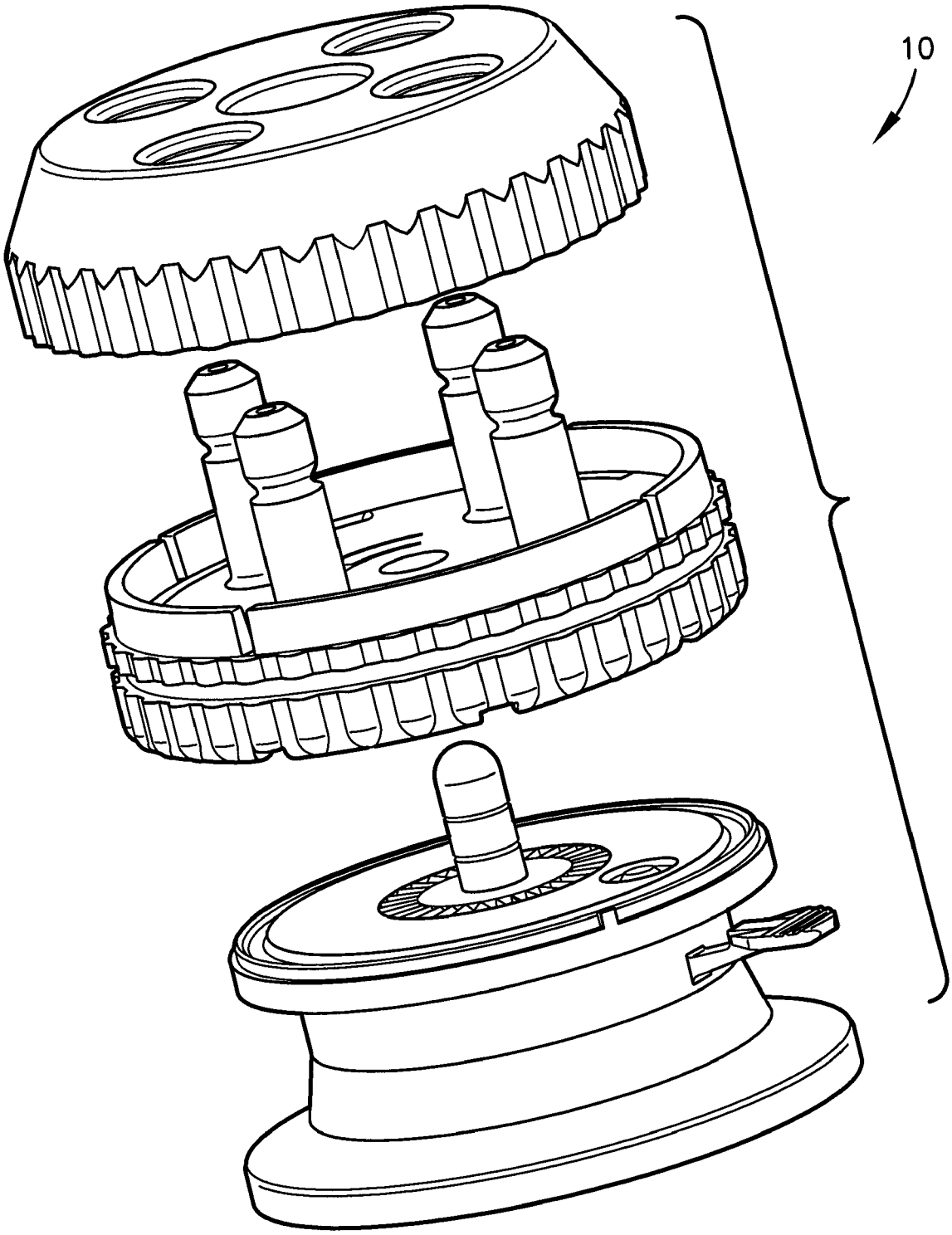
FIG. 9 is an exploded top perspective view of the device of FIG. 1.
Figure 10:
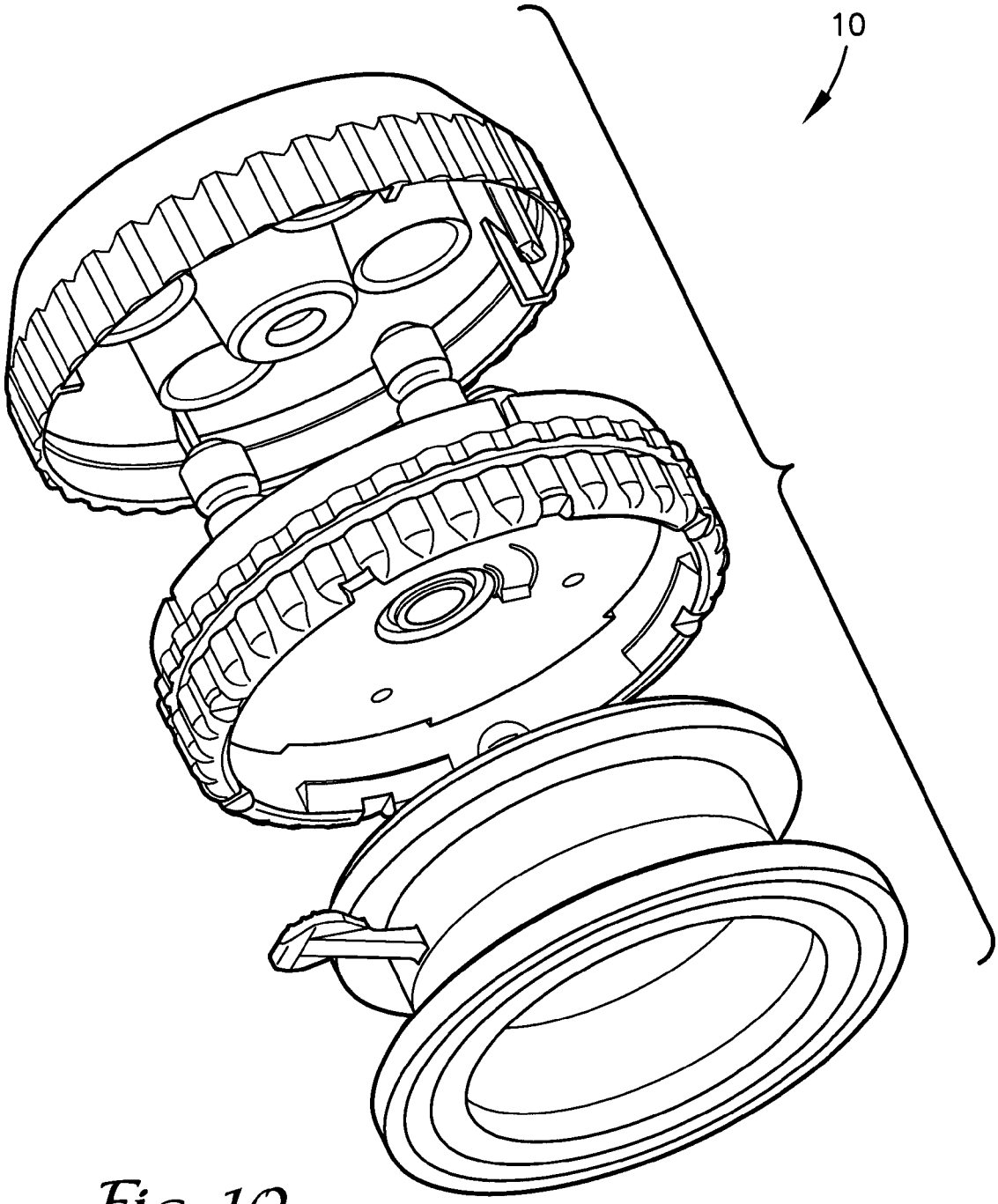
FIG. 10 is an exploded bottom perspective view of the device of FIG. 1.

Referring also to FIG. 5, the cover 16 allows for securing the sample coupling 14 to the sanitary fitting 12 and facilitates attaching and retaining the tubing or other structure to the nipples 56. The cover 16 includes a center opening 62 and a plurality of surrounding openings 64. The center opening 62 fits over the connector projection 36 of the sanitary fitting 12 such that a surface of the cover 16 is located between the first and second grooves 40, or channels, in the connector projection 36.

The retainer mechanism 18 engages the connector projection 36 and cover 18 to substantially prevent relative movement therebetween. The retainer mechanism 18 may take the form of first and second clips operable to engage, respectively, the first and second grooves 40, or channels, thereby trapping the cover surface between the clips and substantially preventing movement of the cover 16 relative to the sample coupling 14.

The plurality of surrounding openings 64 each fits over a respective one of the nipples 56, leaving at least an end portion of each nipple 56 accessible. An inner surface of each of the surrounding openings 64 presents a raised portion 66 which asserts a retaining force on the tubing inserted into the surrounding opening 64 and over the nipple 56. The cover 16, once installed, is not movable relative to the sample coupling 14 because one or more peripheral projections 82 in the cover 16 positively engage one or more peripheral recesses 86 in the sample coupling 14 in order to prevent such relative motion. The cover 16 may present knurling or other contouration on its outer gripping surface to facilitate gripping the cover 16 and associated sample coupling 14 when turning the sample coupling 14 relative to the sanitary fitting 12 in order to align or not align the first port 32 with the second ports 52.

Additionally, the device 10 may further include a final stop mechanism for preventing turning the sample coupling 14 more than approximately 360 degrees relative to the sanitary fitting 12 and thereby preventing reuse of a previously used nipple 56. The final stop mechanism includes a locking pin 84 on or near a lower wall surface of the cover 16, a first locking pin opening 88 on or near an upper wall surface of the sample coupling 14, and a second locking pin opening 90 on or near an upper wall surface of the sanitary fitting 12. When the sample coupling 14 and the cover 16 are initially brought together, and the locking projection 84 extends through the first locking pin opening 88, and rides in a groove, or channel provide in the sanitary fitting 12. Once the sample cover 14 and the cover 16 have rotated approximately 360 degrees relative to the sanitary fitting 12, the locking pin 84 aligns with and penetrates the second pin locking opening 90, thereby locking all three components together and preventing any further relative movement therebetween.

In exemplary use and operation, referring also to FIG. 12, the present invention may function substantially as follows. The pre-sterilized device 10 is removed from its packaging being already coupled with associated tubing and sample bags. The sanitary fitting 12 is secured over the existing opening 211 in or on the container 210 such that the container mating surface 26 seals against the container surface. The inside of the container 210 is then sterilized, such as by a Steam-in-Place (SIP) or Clean-in-Place (CIP) process, such that the inside of the sanitary fitting 12 is also sterilized as the sterilizing mechanism travels through the opening 211 in or on the container 210 and into the device 10. At this point, the inside of the container 210 and the inside of the device 10, from the sanitary fitting 12 to the sample bags, is sealed and sterile, and the first port 32 is not aligned with one of the second ports 52. The container 210 is then filled with the fluid.

Subsequently, when it is desired to sample the contents of the container 210, the stop selection mechanism 28 is disengaged, the sample coupling 14 and cover 16 are turned until the first port 32 aligns with one of the second ports 52, and the stop selection mechanism 28 is engaged with a next one of the stops 54. The fluid then flows from the container 210, through the aligned ports 32,52 in the device 10, through the associated tube 212, and into the associated sample bag 214 or other container. During filling, the pinch clamp 216 provided on the tubing 212 allows for temporarily slowing or stopping the flow of fluid. When finished, the stop selection mechanism 28 is again disengaged, the sample coupling 14 and cover 16 are turned until the first port 32 is aligned with an area between the adjacent second ports 52 such that the first port 32 is sealed, and the stop selection mechanism 28 is engaged with a next one of the stops 54. The cutting clamp 218 can then be used to seal and cut the tubing, thereby allowing the filled sample bag to be removed for testing. The process can be repeated as many times as there are nipples 56 and associated tubes 212 and sample bags 214.

Thus, it will be appreciated that the present invention advantageously allows for conveniently accessing the fluid within the container using an existing container opening, thereby avoiding laborious and time-consuming additional machining of the container and avoiding the creation of an additional point through which the controlled conditions within the container may be compromised.

Although the invention has been disclosed with reference to various particular embodiments, it is understood that equivalents may be employed and substitutions made herein without departing from the scope of the invention as recited in the claims.

Having thus described the preferred embodiment of the invention, what is claimed as new and desired to be protected by Letters Patent includes the following:

1. A device for accessing a fluid in a container using an existing container opening, the device comprising:

a sanitary fitting for attaching the device directly to the container over the existing container opening, the sanitary fitting including a first port;

a sample coupling associated with the sanitary fitting, the sample coupling being rotatable relative to the sanitary fitting in a single direction, the sample coupling including at least two second ports, circumferentially spaced from one another, wherein rotation of the sample coupling in the single direction causes one first port to successively align with a single one of the at least two second ports to access fluid through the aligned one first port and the one of the at least two second ports and wherein the at least two second ports are circumferentially spaced from one another so that all other of the at least two second ports are sealed from the first port when one of the at least two second ports of the sample coupling is aligned with the first port of the sanitary fitting, the device further comprising a tab extending externally, laterally away from the sanitary fitting, a portion of the tab being receivable within a plurality of tab stops formed in the sample coupling such that when the tab is received within a tab stop, relative rotation of the sample coupling with respect to the sanitary fitting is prevented, the device further comprising a plurality of teeth operable to allow the sample coupling to rotate relative to the sanitary fitting in the single direction and to prevent relative rotation in an opposite direction, and the device further comprising a final tab stop to prevent rotating the sample coupling relative to the sanitary fitting more than approximately 360 degrees in the single direction, thereby preventing relative movement between the sample coupling and the sanitary fitting in either rotational direction.

2. The device as set forth in claim 1, the sample coupling comprising a plurality of nipples, each nipple separately associated with a different one of the second ports, the device further including for each of the second ports— a sample container for receiving the fluid flowing through the aligned first and second ports; and tubing extending between the nipple and the sample container.

3. The device as set forth in claim 2, further including one or more clamps operable to control flow of the fluid through the tubing.

4. The device as set forth in claim 1, wherein the tab stops are arranged to stop rotation of the sample coupling relative to the sanitary fitting when the first port is aligned with the single one of the second ports and when the sampling coupling is rotated such that the first port is located between adjacent second ports.

5. The device as set forth in claim 1, further including— a gasket surrounding each of the second ports; and a recess in which the gasket is received, wherein the gasket is interlockingly received in the recess so as to substantially prevent movement of the gasket relative to the second ports.

6. The device as set forth in claim 1, further including a cover operable to retain the sample coupling on the sanitary fitting.

7. The device as set forth in claim 6, further including a nipple associated with each of the second ports and operable to connect to tubing for directing the fluid flowing through the aligned first and second ports, and wherein the cover includes an opening corresponding to each of the second ports and through which the respective nipple projects.

* * * * *